US008245648B2

(12) United States Patent
Morichika et al.

(10) Patent No.: US 8,245,648 B2
(45) Date of Patent: Aug. 21, 2012

(54) GUIDED VEHICLE TRANSPORTATION SYSTEM

(75) Inventors: Shunji Morichika, Hiroshima (JP); Katsuaki Morita, Hiroshima (JP); Masahiro Yamaguchi, Hiroshima (JP); Kosuke Katahira, Mihara (JP); Yasuhiro Nagamichi, Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 53 days.

(21) Appl. No.: 12/295,530

(22) PCT Filed: Oct. 31, 2007

(86) PCT No.: PCT/JP2007/071587

§ 371 (c)(1),
(2), (4) Date: Oct. 29, 2008

(87) PCT Pub. No.: WO2008/056685

PCT Pub. Date: May 15, 2008

(65) Prior Publication Data

US 2009/0301342 A1 Dec. 10, 2009

(30) Foreign Application Priority Data

Nov. 6, 2006 (JP) ..... 2006-300562

(51) Int. Cl.
*B61F 9/00* (2006.01)

(52) U.S. Cl. ..... 104/243; 104/248

(58) Field of Classification Search ..... 105/144, 105/145, 242–248; 104/119, 120
See application file for complete search history.

(56) References Cited

U.S. PATENT DOCUMENTS 3,077,165 A * 2/1963 Vittorelli ..... 104/247
3,822,648 A * 7/1974 Ishii et al. ..... 104/245
4,090,452 A * 5/1978 Segar ..... 104/247
4,132,175 A * 1/1979 Miller et al. ..... 104/130.07

(Continued)

FOREIGN PATENT DOCUMENTS

JP 48-47014 7/1973

(Continued)

OTHER PUBLICATIONS

Microfilm of the Specificaiton and Drawings Annexed to the Request of Japanese Utility Model Application No. 106113/1984 (Laid-Open No. 21601/1986) (Taisei Corp.) Feb. 7, 1986.

(Continued)

*Primary Examiner* — S. Joseph Morano
*Assistant Examiner* — Zachary Kuhfuss
(74) *Attorney, Agent, or Firm* — Kanesaka Berner & Partners, LLP

(57) ABSTRACT

A guided vehicle transportation system is described in the application. The system includes guard wheels and a guard rail positioned along a center line of a guide track. The guard rail has a groove in which the guard wheels are received with a predetermined clearance between the periphery of the guard wheels and side walls of the groove. The guard rail has a flange extending toward the groove at the top of each side wall. The vehicle has first arms extending in longitudinal direction and being attached rotatably at a central part of an axle provided for suspending each pair of front wheels and rear wheels, and the guard wheels are attached rotatably and directly to the both end parts of the first arms or attached rotatably to both end parts of second arms each of which is attached to a corresponding end part of the first arms.

3 Claims, 15 Drawing Sheets

U.S. PATENT DOCUMENTS 7,624,685 B2 12/2009 Andreasson et al.

FOREIGN PATENT DOCUMENTS

| | | | |
|---|---|---|---|
| JP | 48-54608 | | 8/1973 |
| JP | 48-78601 | | 10/1973 |
| JP | 50-25202 | U | 3/1975 |
| JP | 51-60313 | | 5/1976 |
| JP | 51-19642 | B2 | 6/1976 |
| JP | 52079422 | A | 7/1977 |
| JP | 53-808 | Y2 | 1/1978 |
| JP | 53-6404 | B2 | 3/1978 |
| JP | 53-26262 | Y2 | 7/1978 |
| JP | 53107018 | A | 9/1978 |
| JP | 61-18974 | | 2/1986 |
| JP | 61-21601 | | 2/1986 |
| JP | 61-184165 | A | 8/1986 |
| JP | 6-10071 | | 2/1994 |
| JP | 2002178911 | | 6/2002 |
| JP | 2002351544 | | 12/2002 |
| JP | 2006175962 | | 7/2006 |
| JP | 2006-306334 | A | 11/2006 |
| JP | 2006-525179 | | 11/2006 |

OTHER PUBLICATIONS

Microfilm FO the Specification and Drawings Annexed to the Request of Japanese Utility Model Application No. 106113/1984 (Laid-Open No. 21601/1986) Taisei Corp) Jul. 2, 1986.

Office Action issued in corresponding Chinese Application No. 200780012702.X on May 11, 2010.

Japanese Office Action for 2006-300562, issued Nov. 7, 2011.

English Translation of Japanese Office Action for 2006-300562, issued Nov. 7, 2011.

Office Action from corresponding Japanese Application No. 2006-300562 dated Mar. 25, 2011.

* cited by examiner (A)

(B)

Enlarged view of i (A)

(B)

Enlarged view of j (A)

(B)

(A)

(B)

(PRIOR ART)

(PRIOR ART)

(PRIOR ART)

(PRIOR ART)

(A)

(B)

(PRIOR ART)

GUIDED VEHICLE TRANSPORTATION SYSTEM

CROSS-REFERENCE TO RELATED APPLICATIONS

The present Application is based on International Application No. PCT/JP2007/071587, filed on Oct. 31, 2007, which in turn corresponds to Japanese Application No. 2006-300562 filed on Nov. 6, 2006, and priority is hereby claimed under 35 USC §119 based on these applications. Each of these applications are hereby incorporated by reference in their entirety into the present application.

BACKGROUND OF THE INVENTION

1. Field of the Invention

The present invention relates to a guided vehicle transportation system in which a vehicle supported by traveling wheels such as rubber-tires wheels for example travels on a guideway, the vehicle being equipped with an automatic steering mechanism and a fail-safe mechanism for coping with a case malfunction has occurred in the automatic steering mechanism or strong external lateral force exerts on the vehicle.

2. Description of the Related Art

In a new transit system, a vehicle which travels by driving rubber-tired wheels is generally provided with guide wheels which are guided along a guide rail laid down on a guideway along the guideway so that the vehicle is steered to travel along the guideway, and the vehicle is usually steered mechanically.

The mechanical guide mechanism is superior in point of view of safety and reliability, however, structure of bogies to which the wheels and driving mechanism thereof are mounted becomes complicated inevitably, is increased in weight, and results in increased running costs. Further, it is necessary to lay down the guard rail having enough strength to support the guide wheels all along the guideway with high accuracy, which results in increased construction costs of the guideway.

In order to eliminate the above problem, a steering system not requiring a guide rail is proposed in Japanese Laid-Open Patent Application No. 2002-351544 (patent literature 1).

The steering system of a guided vehicle disclosed in the patent literature 1 is composed such that a plurality of on-ground devices which memorize and send out information necessary for the operation of the vehicle are laid down along the whole length of the track on which the vehicle travels, the control device installed on the vehicle emits signals based on the information sent out from the on-ground devices when the vehicle travels along the track, and the vehicle is steered by the steering device installed on the vehicle in accordance with the signals. With the steering system, a guide rail for steering the vehicle is not required, construction and maintenance costs can be reduced, and also vibration and noise are reduced.

A plurality of on-ground devices without electric power sources is located along whole length of the track at a predetermined spacing with specific information being memorized in each of the on-ground devices. The specific information includes the discrimination number, position information, track information, and control information of each concerned on-ground device.

Position information (geographic site information) is information concerning the position of each on-ground device such as the absolute coordinate point and distance from a reference point. Further, track information concerning conditions of the track at the site of each on-ground device such as the gradient, curvature, cant, ramification of the track are memorized in each of the on-ground device as necessary.

Although each of the on-ground devices is not exited, i.e. has not been provided with a power source, it emits signals of the information memorized upon receiving electric power by means of radio waves. The on-ground device has for example an electronic circuit including ROM for memorizing operation information.

The steering device mounted to the vehicle is provided with a transmitter for supplying electric power to the on-ground devices by means of radio waves, a receiver for receiving the operation information emitted from the on-ground device upon receiving the electric power, and a controlling device which performs prescribed data processing based on the operation information received by the receiver and sends a speed directive to the drive motor for driving the wheels and a steering directive to the actuator for turning the wheels by means of the tie rod.

However, according to the steering system disclosed in the patent literature 1, as mechanical steering by means of the guide rail and guide wheels is not provided, it is difficult to secure safety of vehicle traveling against runaway and running out of track when malfunction occurs in the steering system and under abnormal circumstances caused by strong wind, rainfall, snowfall, etc. Further, there occur gradual deviations of the vehicle from the running course caused by changes in the road friction coefficient, the number of passengers, and wear of the tires, so it is needed to correct such deviations in order to secure safe and efficient high speed traveling of the vehicle.

The applicant of this patent application proposed a fail-safe mechanism to meet such a need in Japanese Laid-Open Patent Application No. 2006-175962 (patent literature 2). This fail-safe mechanism will be explained with reference to FIGS. 11 to 13. FIG. 11 is a schematic plan view of the prior art guided vehicle transportation system, FIGS. 12A, B, and C are schematic plan view of the prior art guided vehicle transportation system for explaining steering of the rubber-tired front wheels, FIG. 13A is a schematic elevational view of the prior art guided vehicle transportation system, and FIG. 13B is a side elevational view of FIG. 13A.

In FIGS. 11 to 13, a letter 'a' is added to each of reference numerals of constituent parts and devices composing the front wheel part of a vehicle 01, a letter 'b' is added to each of reference numerals of constituent parts and devices composing the rear wheel part of a vehicle 01, and when not discriminating between the front wheel part and rear wheel part those letters are omitted and indicated only by reference numerals.

In FIG. 11, the vehicle 01 travels along a guideway 08 on which a guard groove 03 is formed to extend along the guideway 08. The vehicle 01 is supported by a pair of rubber-tired front wheels 04*a* and a pair of rubber-tired rear wheels 04*b* with. These pairs of front and rear wheels can be turned in lateral horizontal direction by shifting tie rods 05 in the longitudinal direction thereof. The tie rods 05 can be shifted by actuators 06. As shown in FIG. 12A showing a front wheel part, the actuator 06*a* is controlled according to an automatic steering system 09 disclosed in the patent literature 1.

An arm 021 to which a pair of guard wheels is attached as mentioned later is connected to the actuator 06 so that the arm 021 is turned by the actuator 06 to direct in the same direction as the pair of front or rear wheels 04. A fail-safe mechanism is composed by the guard groove 03 and the arm 021. In FIGS. 12A, 12B, 12C, 13A, and 13B are shown the front wheel part of the vehicle 01. The steering mechanism and fail-safe mechanism 02 of the vehicle 01 are composed the same in the front and rear wheel parts, and their operations will be explained by taking the front wheel part as an example in FIGS. 12 and 13.

The actuator 06*a* is attached to a bogie 01*a* supporting the vehicle 01 as shown in FIG. 13. In FIG. 12, the tie rod 05*a* is composed of a connecting rod 011*a* which is connected to a moving part not shown in the drawings of the actuator to be capable of being shifted in its longitudinal direction and left and right steering rods 013*a*, 13*a* which are connected to the left and right wheels 04*a*, 04*a* respectively. The steering rods 13*a* are connected rotatably to both ends of the tie rod 05*a* by means of pivot joints 012*a* respectively, and the steering rods 013*a* are attached to the front wheels 04*a* respectively so that the longitudinal direction of the steering rod 013*a* always coincides with the turning direction of the front wheel 04*a*, that is, the steering rod 013*a* turns together with the front wheel 04*a*.

With this construction, the vehicle 01 travels along the guideway 08 with the wheels steered through shifting the tie rod 05*a* by the actuator 06*a* controlled by the automatic steering system 09.

In FIGS. 12 and 13, the arm 021*a* is attached to the bogie 01*a* via a support shaft 024*a* rotatable about the support shaft. A pair of guard wheels 022*a* and 023*a* is provided rotatably to the arm 021 on the under side thereof at positions sandwiching the support shaft 024*a*. The tie rod 05*a* and support shaft 024*a* are preferably made of metal of high strength, since they experience reaction forces from the front wheels 04*a* and guard wheels 022*a* and 023*a*.

FIG. 14 is an enlarged plan view of the arm 021*a* and associated parts, and FIG. 15 is a perspective view of the guard wheel 022*a* or 023*a*. As shown in FIG. 14 and FIG. 15, the guard wheel 022*a*(023*a*) is composed of a central shaft 026(027) made of aluminum for example. The tire is preferably made as a self-sealing tire consisting of urethane rubber which is highly resistant to vibration and wear and a steel belt used for a rubber tire, etc. The guard wheels 022, 023 are attached to the arm 021*a* on the under side thereof to be received in the guard groove 03.

The tie rod 05*a* is connected to the moving part of the actuator 06*a*. However, the moving part of the actuator 06*a* and the tie rod 05*a* shift in the longitudinal direction of the tie rod, whereas the arm 021*a* rotates about the support shaft 024*a* and an end of the arm 021*a* follows a circular arc trajectory as the arm 021*a* rotates, so a conversion mechanism of rotation to translational motion 07*a* is provided so that the moving part of the actuator 06*a* and the tie rod 05*a* can be moved in the longitudinal direction of the tie rod 05*a* accommodating the circular arcuate motion of the end of the arm 021*a*.

As shown in FIG. 12A, the support shaft 024*a* of the arm 021*a* is located on a line b connecting the centers of the front wheels 04*a*, and the connecting rod 011*a*, the steering rods 013 which are integral with the front wheels respectively, and the line b constitute a parallelogram, so the front wheels 04*a* are turned to the same direction as the arm 021*a* by the actuation of the actuator 06*a*.

As shown in FIGS. 13A and 13B, the guard wheels 022*a* and 023*a* are received in the guard groove 03 formed along the guideway 08, and such a clearance is retained between each of the side walls of the guard groove 03 respectively that it is smaller than a clearance with which the vehicle 01 does not deviate than a permissible deviation in its travel direction.

With the fail-safe mechanism provided, the vehicle 01 travels along the guideway 08 while the actuator 06*a* is driven by the automatic steering mechanism disclosed in the patent literature 1 and the front wheels 04*a* are steered by the actuator 06*a*. As the arm 021*a* is moved to direct in the same direction as the front wheels 04*a*, the guard wheels 022*a* and 023*a* travels in the guard groove 03 without contacting the side walls of the guard groove 03 as the vehicle travels along the guideway 08.

When malfunction occurs in the automatic steering system 09 and there occurs a fear of running off of the vehicle 01 from the guideway 08, the guard wheels 022*a*, 023*a* contact the side walls of the guard groove 03 to prevent running off of the vehicle 01 from the track. Therefore, the vehicle does not deviate than a permissible deviation in its travel direction and deviation exceeding the permissible deviation and derailment of the vehicle 01 can be prevented with certainty.

Therefore, safety and reliability of guided vehicle transportation can be secured even when malfunction occurs in the steering system of the vehicle. Further, fail-safe operation can be achieved with the very simple construction, not only simplification and weight saving of the vehicle, but also simplification of on-ground facilities and cost reduction of infrastructure can be achieved.

Further, the guard wheels 022*a*, 023*a* do not contact the side walls of the guard groove 03 as far as the automatic steering system 09 functions normally, so extra forces do not exert on the vehicle due to friction between the guard wheels and side walls of the guard groove.

However, with the fail-safe mechanism disclosed in the patent literature 2, when external force c due to a gust of cross wind of instantaneous wind velocity of 60 m/s or larger exerts on the vehicle 01 in the lateral direction as shown in FIG. 16A, the vehicle 01 is initially moves laterally and the guard wheels 022, 023 contact one of the side walls of the guard rail 03. When the cross wind is very strong, the side wall 03*a* of the guard groove of the guard rail 03 is deformed by lateral forces exerting from the guard wheels 022, 023, and a moment d is produced about the ground contact point f of the rubber tire of the front wheel 04 of the lee side due to the lateral force c as shown in FIG. 16B. Although a moment m is exerting due to the vehicle weight about the ground contact point f in the direction reverse to the moment d, there occurs a possibility that the vehicle 01 heels over about the ground contact point f in the direction of wind and topples down.

When the side walls of the guard groove 03 are rigid or the guard groove 03 is formed as a depression on the roadbed, the side wall does not be deformed by the lateral forces exerting from the guard wheels, however, when the sum of the moment d produced by the external lateral force c and a moment e produced by reaction force g exerting on the guard wheel from the lee side wall exceeds the moment m produced by the vehicle weight, the vehicle topples down.

SUMMARY OF THE INVENTION

The present invention was made in light of the background as mentioned above, and the object of the invention is to provide a guided vehicle transportation system in which a fail-safe mechanism is constituted by providing automatic steering mechanisms and guard wheels to the vehicle and a guard rail on the guideway such that fear of toppling down of the vehicle is eliminated with compact system construction even when lateral external force exerts on the vehicle.

The invention proposes a guided vehicle transportation system in which a vehicle travels on a pre-established guideway having a depression as a guide track, the vehicle being provided with automatic steering mechanisms for steering front wheels and rear wheels respectively by means of actuators each being provided for steering the front and rear wheels, the vehicle being provided with guard wheels in its under side rotatably in a lateral plane respectively, a guard rail having a groove in which the guard wheels are received being laid down along the center line of the guide track, a clearance being secured between each of side walls of the groove of the guard rail, a fail-safe mechanism being constituted by the guard wheels and the guard rail, wherein the guard rail has a flange extending toward the groove of the guard rail at the top of each side wall, the guard wheel has thereon a subsidiary guard wheel smaller in diameter than that of the guard wheel to be rotatable together with the guard wheel, and the subsidiary guard wheel comes right under the flange when the vehicle is moved laterally pushed by lateral external force exerting on the vehicle until the periphery of the guard wheel contacts one of the side walls of the groove of the guard rail so that heeling over of the vehicle is prevented by engagement of the subsidiary guard wheel with the lower surface of the flange.

According to the invention, when the vehicle receives lateral external force due to a gust of cross wind of instantaneous wind velocity of 60 m/s or larger for example while the vehicle is traveling, the vehicle is moved toward lee side and the guard wheels contact the side wall of the groove of the guard rail. When the lateral external force is very strong, the traveling wheel of windward side tends to be raised, for the vehicle tends to be heeled over about the ground contact point of the traveling wheel of lee side. However, the subsidiary guard wheels provided on the guard wheels come under the flange of the guard rail, and tilting of the vehicle is prevented by the engagement of the subsidiary guard wheels with the underside surface of the flange.

When exertion of lateral external force ceases, the vehicle is recovered to its normal position with the guard wheels positioned in the central portion of the groove of the guard rail by the automatic steering mechanisms.

The guide rail having a groove is preferably shaped such that a flange part extends toward the groove horizontally from each of upper parts of both side walls respectively.

The same effect of preventing toppling down of the vehicle can be obtained by composing such that the guard rail has a I-shaped cross section having a flange extending laterally toward both sides at its top (T-shaped cross section), the guard rail being laid down along the center line of the guide track, and guard wheels are received in grooves formed with both side walls of the guard rail and both side walls of the guide track which is a depression formed along the guideway with clearances secured between the periphery of the guard wheel and the side wall of the I-shaped guard rail and that of the guide track.

In this case, forming of the guide rail is made easy by adopting the guide rail of I-shaped cross section, and as the guard wheels are received in both grooves formed with both sides of the guard rail and both sides of the guide track, reliability of the fail-safe is increased.

The system of the invention is preferably composed such that the vehicle is provided with first arms in the underside of the vehicle rotatable in a lateral plane about first support shafts fixed to the vehicle, and interlocking gears for connecting the first arms to the steering mechanisms so that the first arms are directed in the same direction as the front wheels and rear wheels respectively, wherein second arms are supported via second support shafts rotatably in a lateral plane at both end parts of each of the first arms respectively, and guard wheels are attached to both end parts of each of the second arms rotatably in a lateral plane respectively, and wherein preloading springs each for energizing each of the second arms so that the guard wheels attached to both end parts of each of the second arms contact both side walls of the guard rail respectively.

With this composition, the subsidiary guard wheels always contact both the guide surfaces, i.e. both the side walls of the groove of the guard rail. The preloading spring presses the guard wheels against the guide surfaces with a spring force not so strong so that the automatic steering mechanism is not affected and wear of the guard wheels does not increase, which will result in reduced durability of the guard wheels, by the exertion of the spring force.

The angle made between longitudinal direction of the second arm and travel direction of the vehicle is preferably 30° or smaller when the guard wheels attached to both end parts of the second arm contact both side walls of the guard rail respectively so that even if stepped parts exist at joining parts of the guard rail the guard wheels proceed along the groove of the guard rail the impact to the guard wheels from the stepped parts can be absorbed through rotation of the second arm against energizing force of the preloading spring.

With this construction, when lateral external force c exerts on the vehicle when traveling, the vehicle is pushed toward lee side until both of the guard wheels contact the lee side guide surface of the guard rail. As the spring force of the preloading spring is determined to be not so strong, the second arm is rotated easily until the guard wheels contacting the guide surface of windward side come to contact the guide surface of leeward side.

When lateral external force is very strong, the traveling wheels of windward side tend to be raised, for the vehicle tends to be heeled over about the ground contact point of each of the traveling wheels of lee side. But in this state the subsidiary guard wheels provided on the guard wheels are engaged under the flange of the guard rail, so tilting and toppling of the vehicle can be prevented.

When exertion of the lateral external force ceases, the normal traveling attitude of the vehicle is recovered by the automatic steering mechanism and the vehicle travels with the guard wheels contacting both guide surfaces of the guard rail respectively pushed by the preloading spring by way of the second arms.

As the guard wheels are always contacting the guide surfaces of the guard rail pushed by the preloading springs and the subsidiary guard wheels are always right under the lower surfaces of the flanges, the upper surfaces of the subsidiary guard wheels come right under the lower surface of the flange of lee side without fail to be engaged with the lower surface of the lee side flange when the vehicle is moved toward lee side.

According to the invention, the guard rail is formed to have a flange part extending laterally from each of the guide surfaces of the guard rail for guiding the guard wheels, a subsidiary guard wheel, which is a disk made of rigid material and smaller in diameter than that of the guard wheel, is provided on each of the guard wheels to be rotatable together with the guard wheel, and the subsidiary guard wheel is engaged with the lower surface of the flange when the periphery of the guard wheel is brought to contact with the lee side guide surface of the guide rail at the initial stage of lateral movement of the vehicle when strong external lateral force exerts on the vehicle, so tilting and toppling down of the vehicle can be prevented at an initial stage the vehicle begins tilting, tilting and toppling of the vehicle can be prevented with requisite minimum force exertion on the guard rail as compared a case tilting and toppling is prevented after the vehicle is somewhat tilted, without receiving impact due to inertia.

The system of the invention is compact in construction, and when exertion of the lateral external force ceases, the vehicle can continue traveling with the normal traveling attitude automatically. Furthermore, even when the rubber tire of the guard wheel is damaged by any causes, the fail-safe function can be maintained by the rigid subsidiary guard wheels.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF DRAWINGS

The present invention id illustrated by way of example, and not by limitation, in the figures of the accompanying drawings, wherein elements having the same reference numeral designations represent like elements throughout and wherein.

DETAILED DESCRIPTION OF THE PREFERRED EMBODIMENT

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

The First Embodiment

Figure 1:
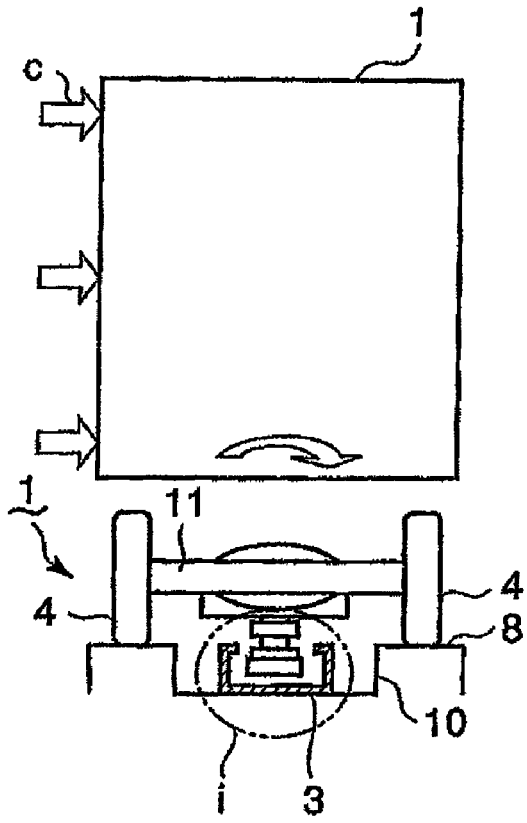
FIG. 1A is a schematic front elevational view of a first embodiment of the present invention showing the vehicle and fail-safe mechanism.
FIG. 1B is an enlarged view of the part surrounded by a circle i in FIG. 1A.
Figure 1:
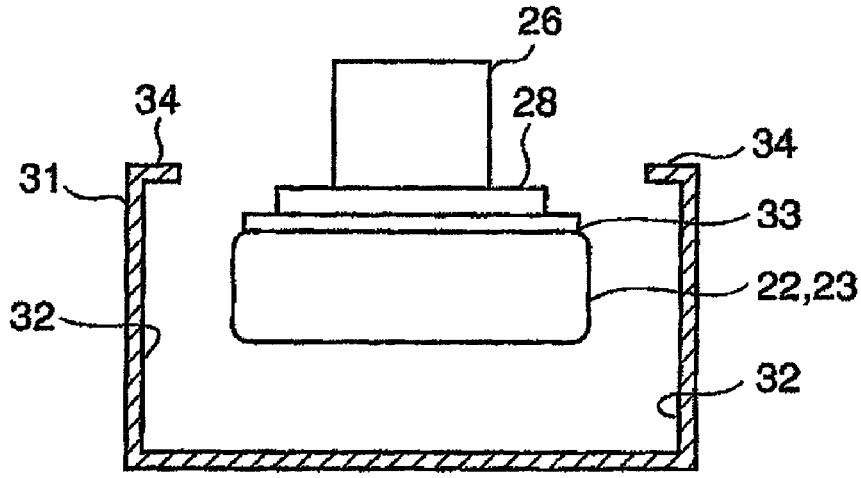
Figure 2:
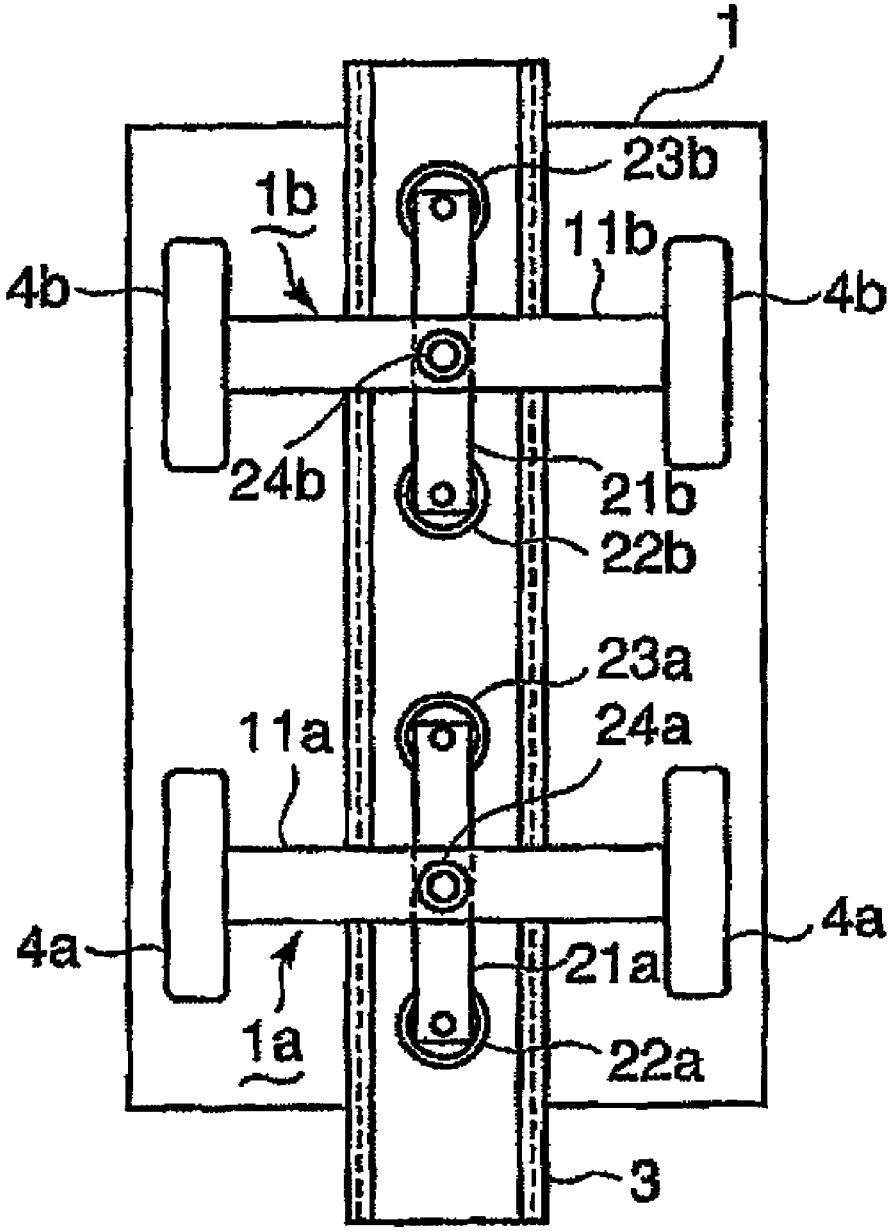
FIG. 2 is a schematic plan view of the first embodiment.
Figure 3:
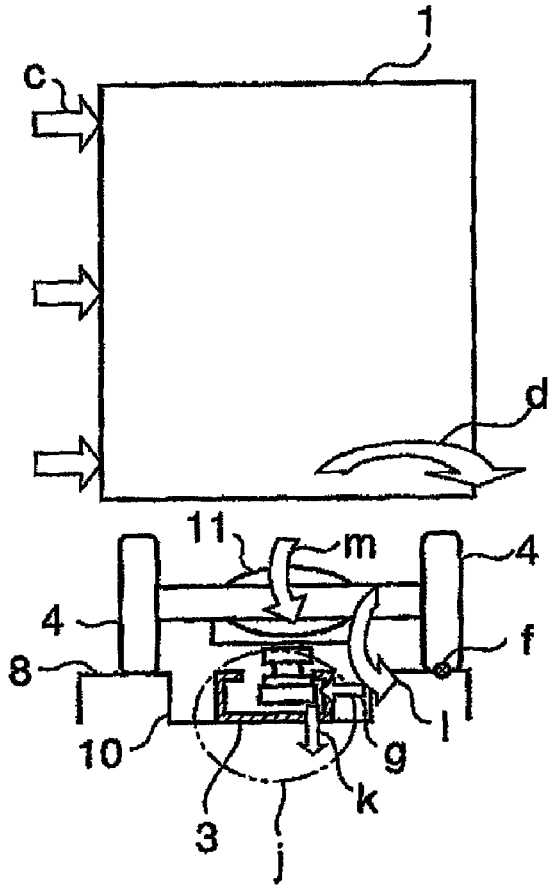
FIG. 3A is a schematic front elevational view of the vehicle and fail-safe mechanism in the first embodiment for explaining action of external forces to the vehicle.
FIG. 3B is an enlarged view of the part surrounded by a circle j in FIG. 3A.
Figure 3:
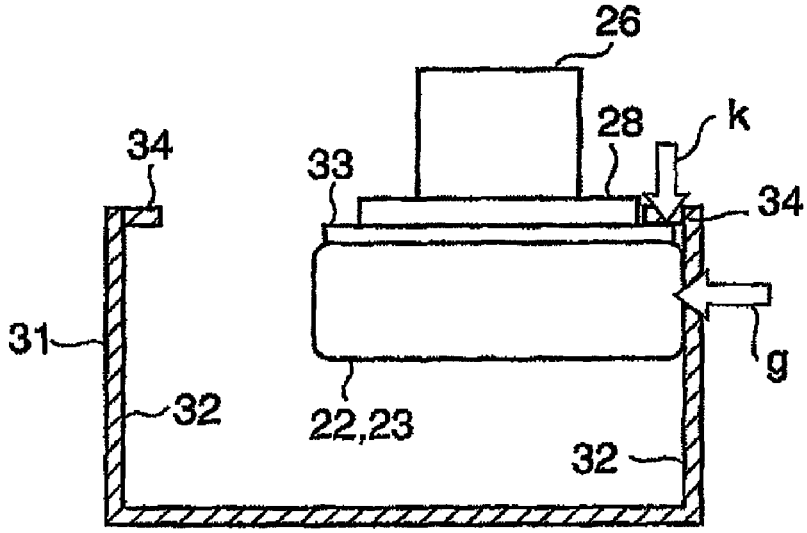

A first embodiment of the present invention will now be explained with reference to FIGS. 1 to 3. FIG. 1A is a schematic front elevational view of the vehicle and fail-safe mechanism, FIG. 1B is an enlarged view of the part surrounded by a circle i in FIG. 1A, FIG. 2 is a schematic plan view, FIG. 3A is a schematic front elevational view of the vehicle and fail-safe mechanism for explaining action of external forces to the vehicle, and FIG. 3B is an enlarged view of the part surrounded by a circle j in FIG. 3A. The first embodiment is based on the premise that the vehicle is provided with the automatic steering mechanism disclosed in the patent literature 1 and the fail-safe mechanism disclosed in the patent literature 2 is provided.

Referring to FIG. 2, a vehicle 1 has a front bogie 1*a* provided with a pair of rubber tired front wheels 4*a* and a rear bogie 1*b* provided with a pair of rubber tired rear wheels 4*b*. In FIG. 2, reference numerals indicating constituent parts and devices of the front wheel part of the vehicle 1 are added with a letter 'a' and those indicating constituent parts and devices of the rear wheel part of the vehicle 1 are added with a letter 'b'. However, as the rear wheel part is composed the same as the front wheel part, letters 'a' and 'b' are not added to the numerals in FIGS. 1 and 3, and also letters 'a' and 'b' are omitted in the description hereunder when not discriminating between the front wheel part and rear wheel part.

In FIG. 2, an arm 21 is attached rotatably via a support shaft 24 to the bogie 1*a*(1*b*) below an axle 11 connecting the pair of rubber-tired wheels 04 at the central part between the wheels. Guard wheels 22 and 23 are attached to the arm 21 at both end parts thereof respectively. In FIG. 1, a depression 10 is formed as a guide track 3 on the surface of a guideway 8 on which the vehicle 1 travels. A guard rail 31 having a rectangular cross section with its upper side open thereby forming a groove on the guide track 3 along the center line thereof. The vehicle 1 travels along the guideway 8 with the guard wheels 22 and 23 positioned in the groove formed by the guard rail 31. The vehicle 1 travels in a state the guard wheels 22 and 23 do not contact the guide faces 32 of the guard rail 31, i.e. side walls of the groove under normal conditions while being steered by an automatic steering mechanism (not shown). The guard wheel is comprised of a shaft made of metal with urethane rubber tire adhered to surround the shaft and attached rotatably to the guide wheel shaft 26 arm 21 via a bearing. The guide wheel shaft 26 is fixed to the arm 21.

A subsidiary guard wheel 33 made of metal and smaller in diameter than the guard wheel 22(23) (smaller by 5 mm for example) is provided between a special washer 28 and the guard wheel 22(23). The diameter of the guard wheel 22 (23) is smaller than the distance between the guide surfaces 32, 32 of the guard rail 31, i.e. the width of the groove of the guard rail 31, by 100 mm for example so that a clearance of 50 mm is secured between the outer periphery of the guard wheel and the side walls of the groove when the guard wheel is positioned at the center of the groove. The guard rail 31 is formed such that a flange 34 extends substantially horizontally inwardly from the top of each of the side walls by 15 mm for example.

Influence of lateral external force c exerting on the vehicle 1 will be explained referring to FIG. 3. When the vehicle 1 experiences lateral external force c while traveling due to a gust of cross wind (cross wind of instantaneous wind velocity of 60 m/s or larger), the vehicle 1 is pushed laterally and the guard wheels 22 and 23 contact the guide face 32 of the guard rail 31.

When the external force c is very strong, the rubber-tired wheel 4 of windward side tends to be raised, for the vehicle 1 tends to be heeled over about the ground contact point f of the rubber-tired wheel 4 of lee side. However, the subsidiary guard wheels 33 of the guard wheels 22 and 23 come under the flange 34 of the guard rail 31, and the subsidiary guard wheels 33 receive reaction force k from the lower surface of the flange 34, so tilting of the vehicle is prevented by the reaction force k. Thus, a counter moment I is produced by the reaction force k against a toppling moment d produced by the lateral external force c and a toppling moment g produced by a lateral reaction force g which exerts on guard wheels 22 and 23 from the guide surface 32, and the counter moment I works to prevent tilting of the vehicle together with a moment m due to the vehicle weight.

When exertion of the external force c ceases, the normal traveling attitude of the vehicle 1 is recovered by the automatic steering mechanism and the vehicle travels with the guard wheels 22 and 23 positioned in the central part of the groove of the guard rail 31. It is necessary that the diameter of the subsidiary guard wheel is larger enough than that of the special washer 28 in order to secure sufficient contact area between the upper surface of the subsidiary guard wheel and the lower surface of the flange 34.

According to the embodiment, toppling of the vehicle can be prevented by means of the guard rail 31 and guard wheels 22, 23 of simple construction, and in addition, heeling over of the vehicle 1 is prevented at an initial stage the vehicle begins tilting, tilting and toppling of the vehicle 1 can be prevented with requisite minimum force exertion on the guard rail as compared a case tilting and toppling is prevented after the vehicle is somewhat tilted, without receiving impact due to inertia.

Further, when exertion of the lateral external force ceases, the vehicle can continue traveling with the normal traveling attitude automatically. Furthermore, even when the rubber tire of the guard wheel is damaged by any causes, the fail-safe function can be maintained by the subsidiary guard wheels 33.

The Second Embodiment

Figure 4:
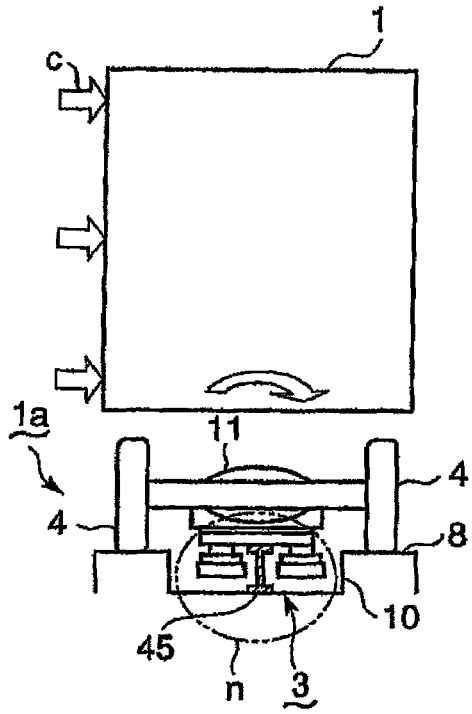
FIG. 4A is a schematic front elevational view of a second embodiment of the present invention showing the vehicle and fail-safe mechanism.
FIG. 4B is an enlarged view of the part surrounded by a circle in FIG. 4A.
Figure 4:
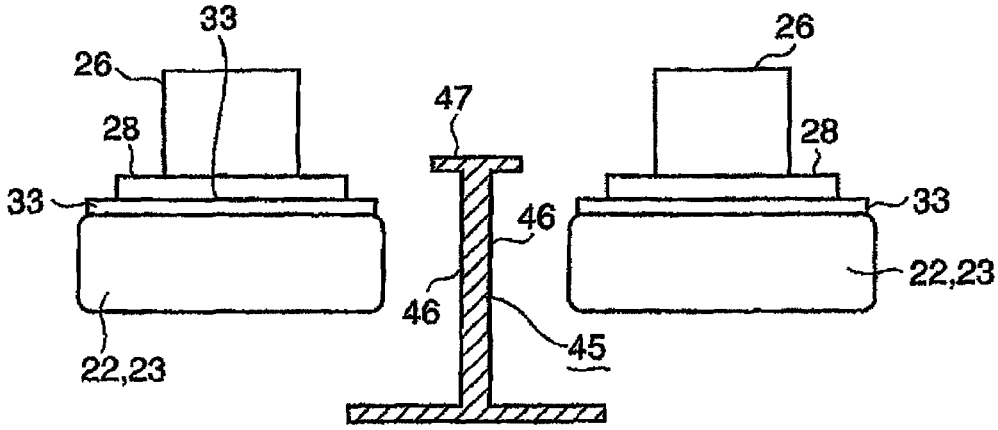

Next, a second embodiment of the invention will be explained referring to FIGS. 4 to 6. FIG. 4A is a schematic front elevational view showing the vehicle and fail-safe mechanism, and FIG. 4B is an enlarged view of the part surrounded by a circle in FIG. 4A, FIG. 5 is a schematic plan view, FIG. 6A is a schematic front elevationnal view of the vehicle and fail-safe mechanism for explaining action of external forces to the vehicle, and FIG. 6B is an enlarged view of the part surrounded by a circle o in FIG. 6A.

Figure 5:
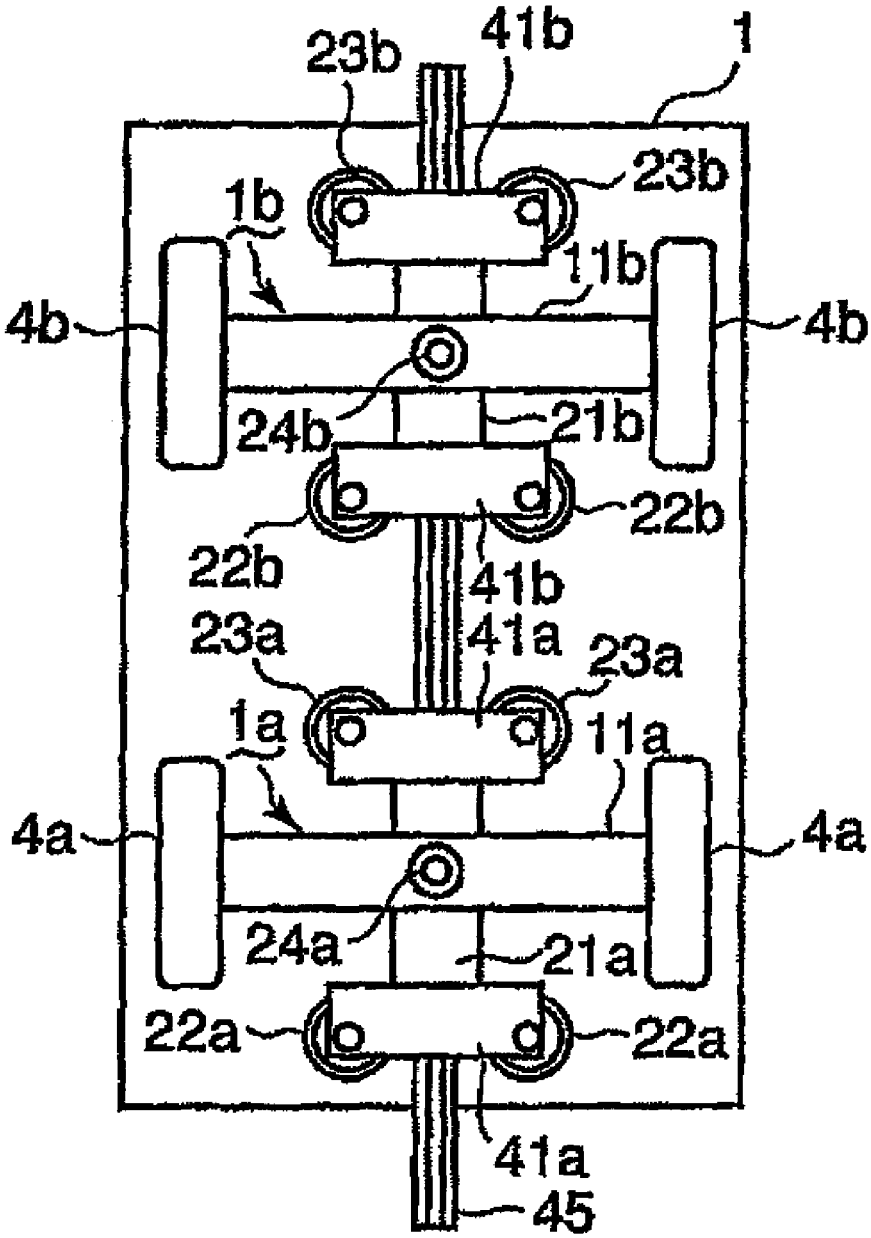
FIG. 5 is a schematic plan view of a second embodiment of the present invention.
Figure 6:
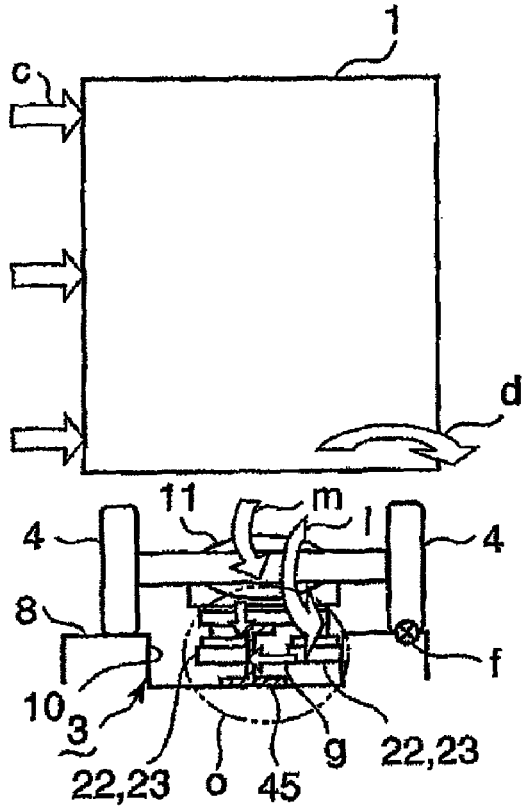
FIG. 6A is a schematic front elevational view of the vehicle and fail-safe mechanism in the second embodiment for explaining action of external forces to the vehicle.
FIG. 6B is an enlarged view of the part surrounded by a circle o in FIG. 6A.
Figure 6:
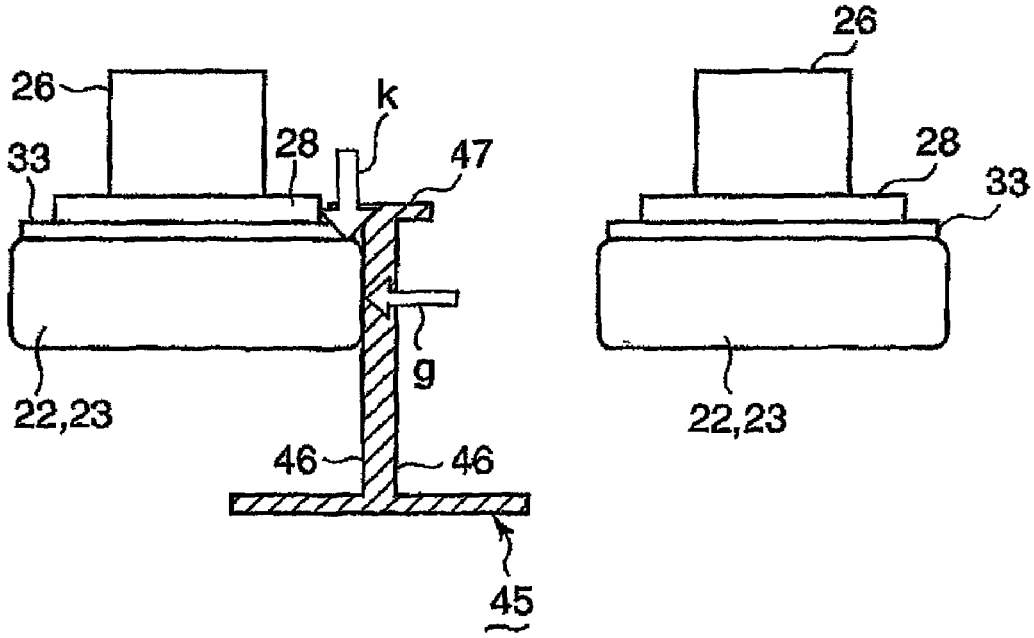

Referring to FIG. 5, in the second embodiment, a second arm 41 is attached to each of both end parts of an arm 2, and guard wheels 22 and 23 are attached respectively to both end parts of each of the second arms 41.

As shown in FIGS. 4A and 4B, according to the second embodiment, a guard rail 45 having an I-shaped cross section and the guard rail 45 is laid down on the bottom of a depression 10 (guide track 3) formed along the guideway 8 along the center line of the depression. Therefore, two grooves are formed in the guide track 3 partitioned with the I-shaped guard rail 45 into two guide tracks. The guard wheels 22, 23 attached to one end of the second arm 41 are received in one of the grooves and the guard wheels 22, 23 attached to the other end of the second arm 41 is received in the other groove of the partitioned grooves. At the top of the guard rail 45 is formed a flanges 47 extending toward both sides thereof. Construction other than that mentioned above is the same as that of the first embodiment, and parts and devices the same as the first embodiment are denoted by the same reference numerals and explanation is omitted.

The diameter of the subsidiary guard wheel 33 is smaller than that of the guard wheel 22(23) as is in the first embodiment. The clearance between the guide surface 46 of the guard rail 45 and the periphery of the guard wheel 22(23), and the horizontal protrusion of the flange 47 from each of the guide surfaces 46 of the guard rail 45, are the same those of the first embodiment.

When the vehicle experiences lateral external force c due to a gust of cross wind, etc., the vehicle 1 is pushed laterally and the upper surfaces of the subsidiary wheels 22 and 23 come under the lower surface of the flange 47, and heeling over and toppling down of the vehicle can be prevented.

That is, a counter moment I is produced by reaction force k exerting on the subsidiary wheel 33 from the flange 47, and the moment I and a moment m due to the vehicle weight act in the direction opposite to a moment d produced by the lateral external force c and a moment produced by the reaction force g exerting on the guard wheels 22 and 23 from the guide surface of the guard rail 45, so heeling over and toppling down of the vehicle 1 can be prevented. Therefore, the second embodiment effects to prevent toppling down of the vehicle, as does the first embodiment.

The Third Embodiment

Figure 7:
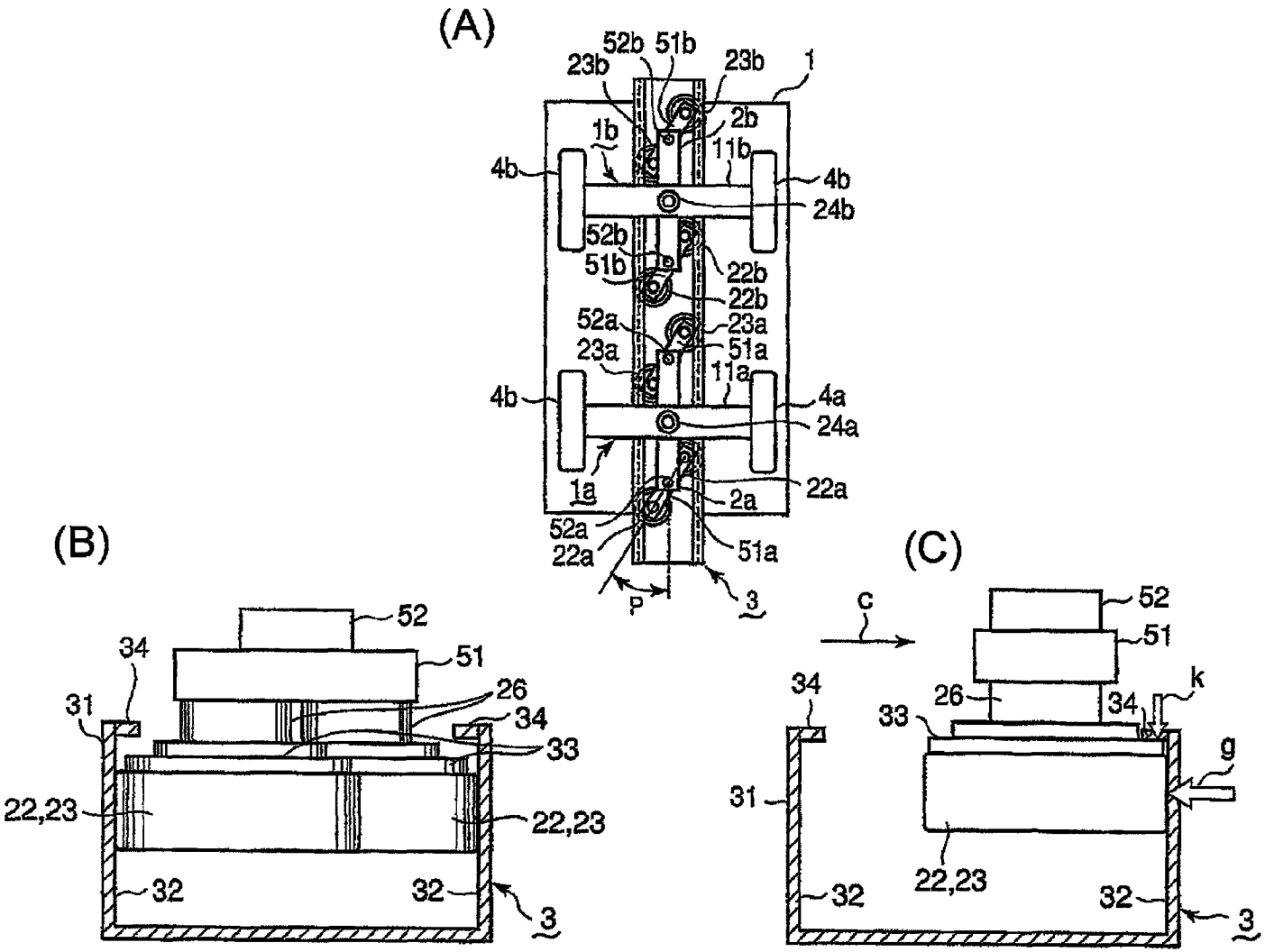
FIG. 7A is a schematic plan view of a third embodiment of the present invention.
FIG. 7B is a partial cross sectional view of FIG. 7A showing the guard wheels engaged into the groove of the guard rail.
FIG. 7C is an illustration when the guard wheels moved to one side in the guard rail due to exertion of external lateral force to the vehicle.
Figure 8:
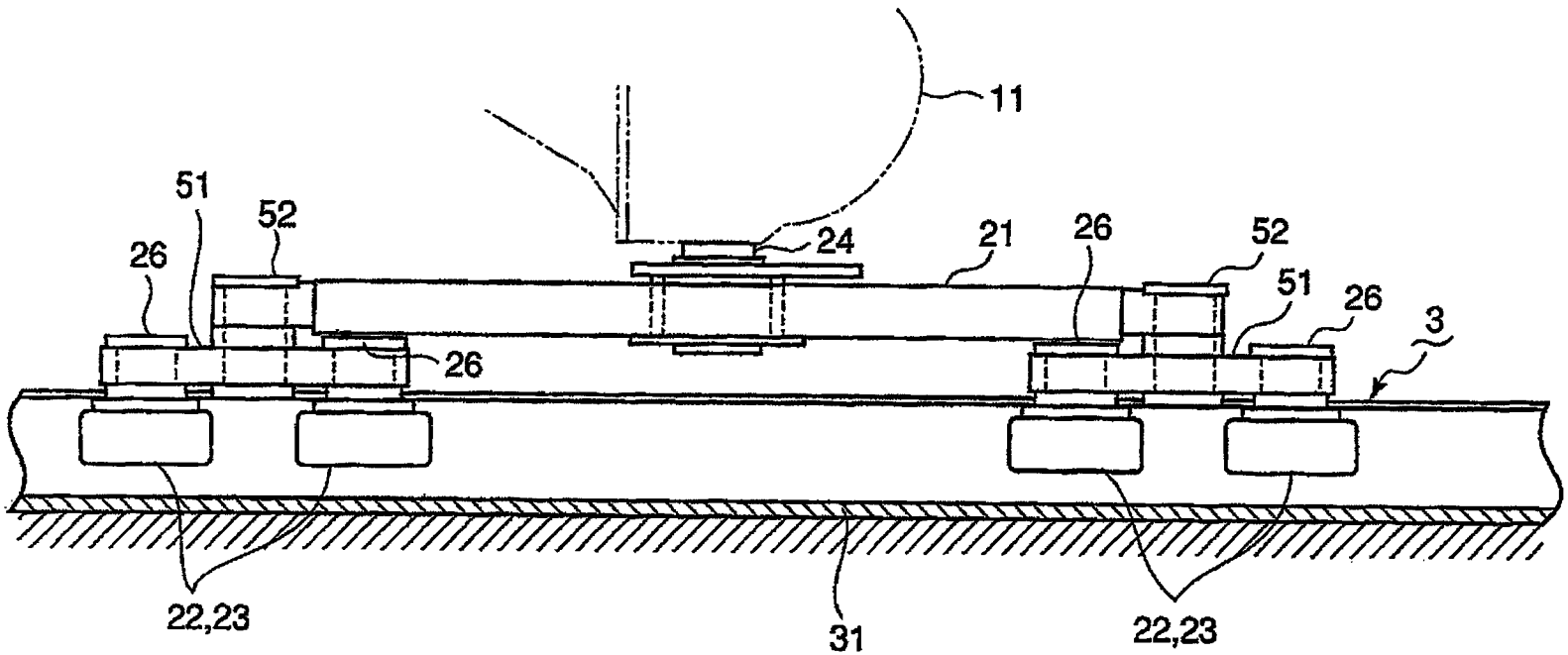
FIG. 8 is a schematic side elevational view of the fail-safe mechanism in the third embodiment.

Next, a third embodiment of the invention will be explained referring to FIGS. 7 to 10. FIG. 7A is a schematic plan view, FIG. 7B is a partial cross sectional view of FIG. 7A showing the guard wheels engaged into the groove of the guard rail, FIG. 7C is an illustration when the guard wheels moved to one side in the guard rail due to exertion of external lateral force to the vehicle, FIG. 8 is a schematic side elevational view of the fail-safe mechanism, FIG. 9 is a schematic plan view showing a pair of guard wheels engaging with the side walls of the guard rail, and FIG. 10 is a schematic side view showing a pair of guide wheels and associated parts.

Referring to FIGS. 7A and 7B, a second arm 51 is attached rotatably via a support shaft 52 to an arm 2 at both end parts thereof. Guard wheels 22 and 23 are attached respectively via a guard wheel shaft 26 to each of both end parts of the second arms 51.

Figure 9:
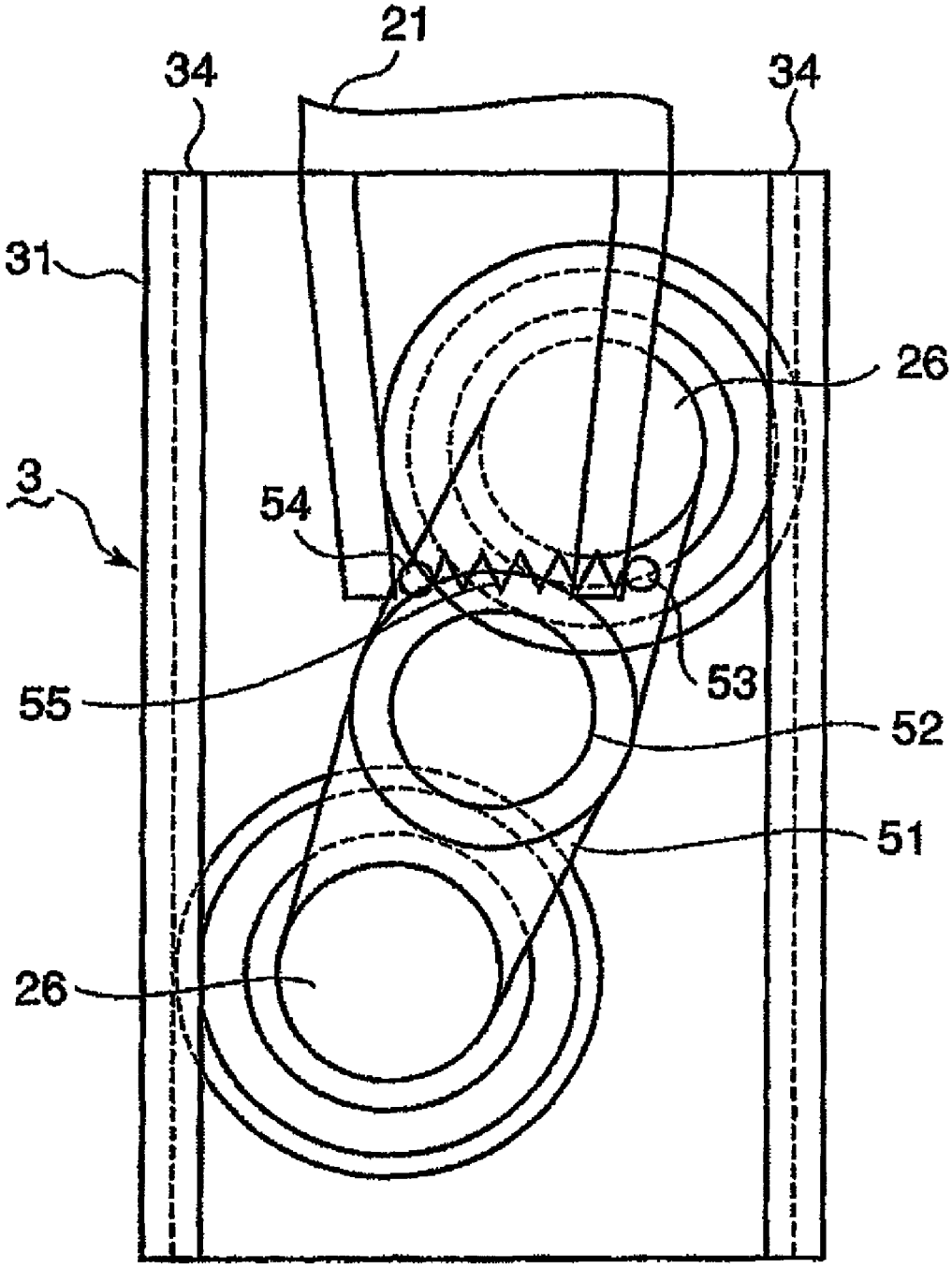
FIG. 9 is a schematic plan view showing a pair of guard wheels of FIG. 8 engaging with the side walls of the guard rail.
Figure 10:
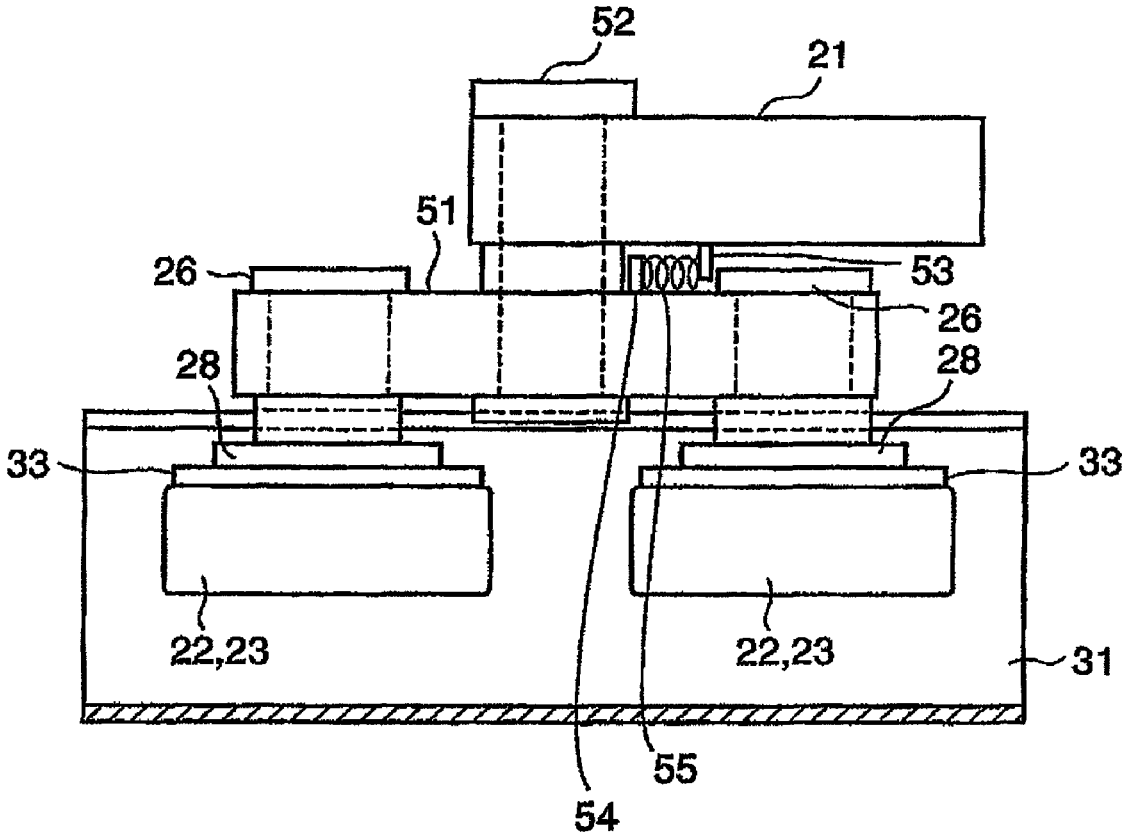
FIG. 10 is a schematic side view showing a pair of guide wheels of FIG. 9 and associated parts.
Figure 11:
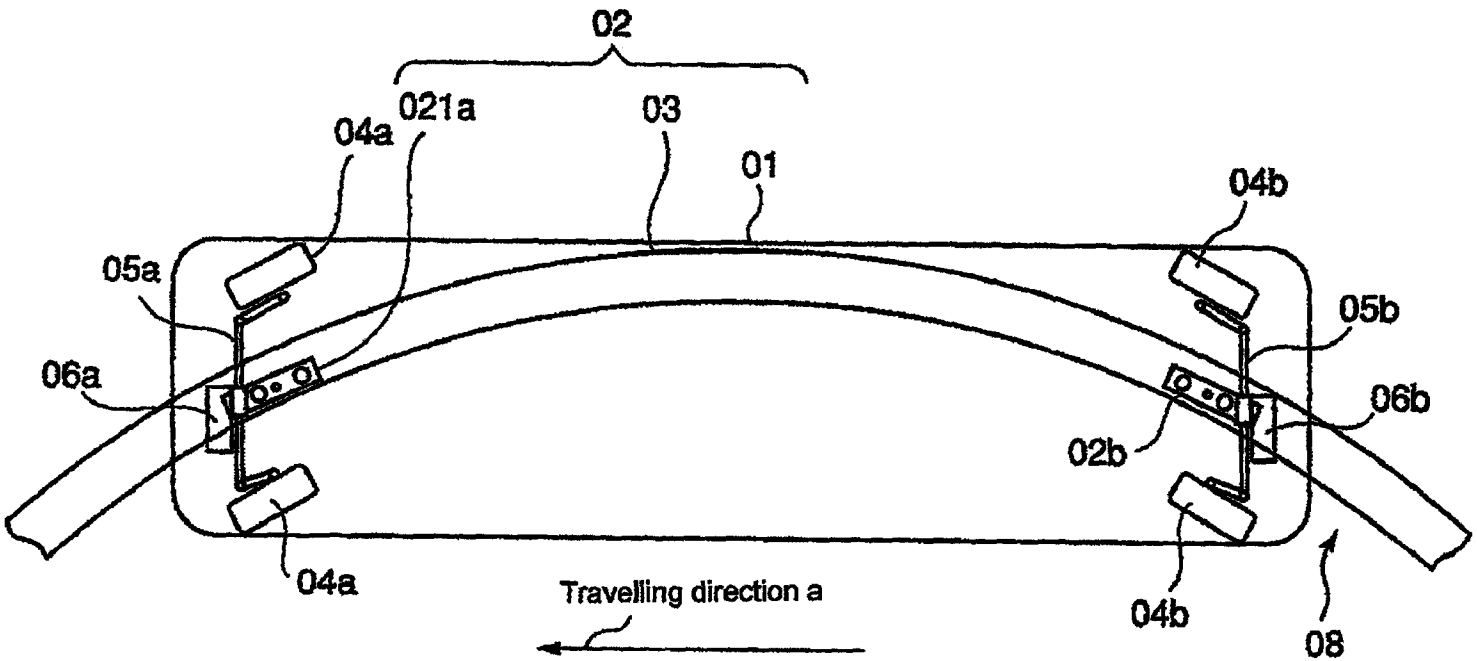
FIG. 11 is a schematic plan view of the prior art guided vehicle transportation system.
Figure 12:
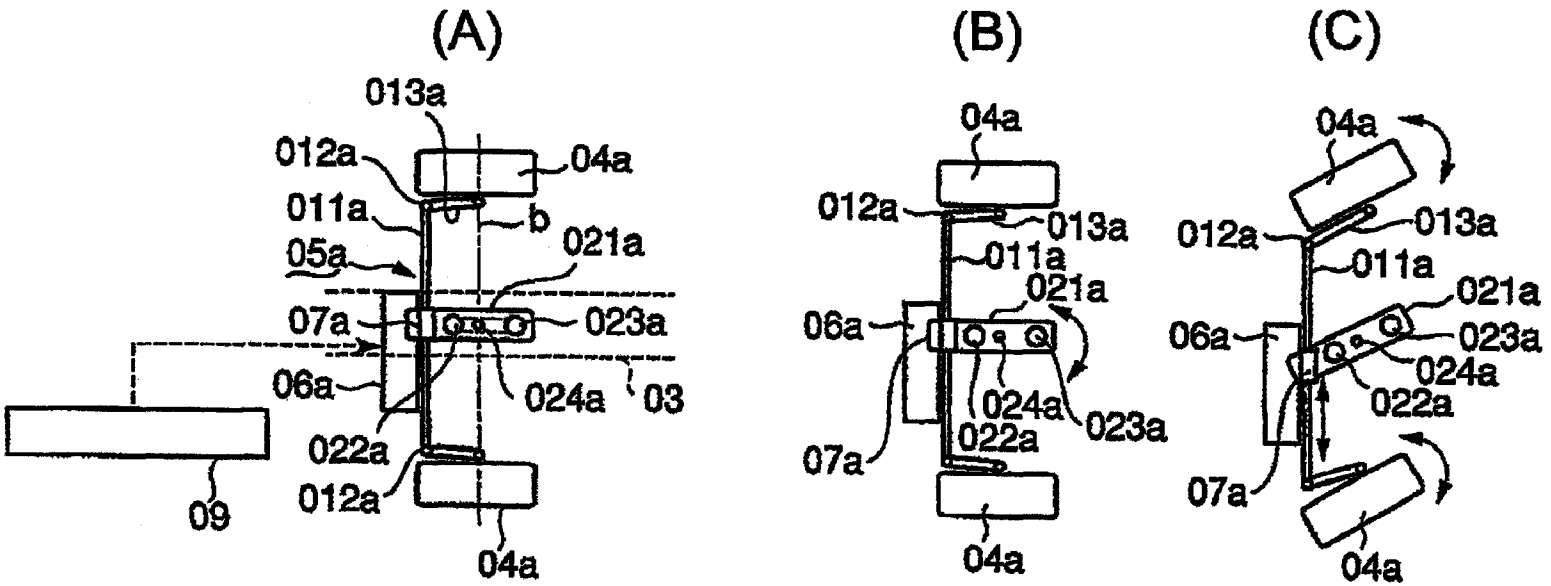
FIGS. 12A, B, and C are schematic plan view of the prior art guided vehicle transportation system for explaining steering of the rubber-tired front wheels.
Figure 13:
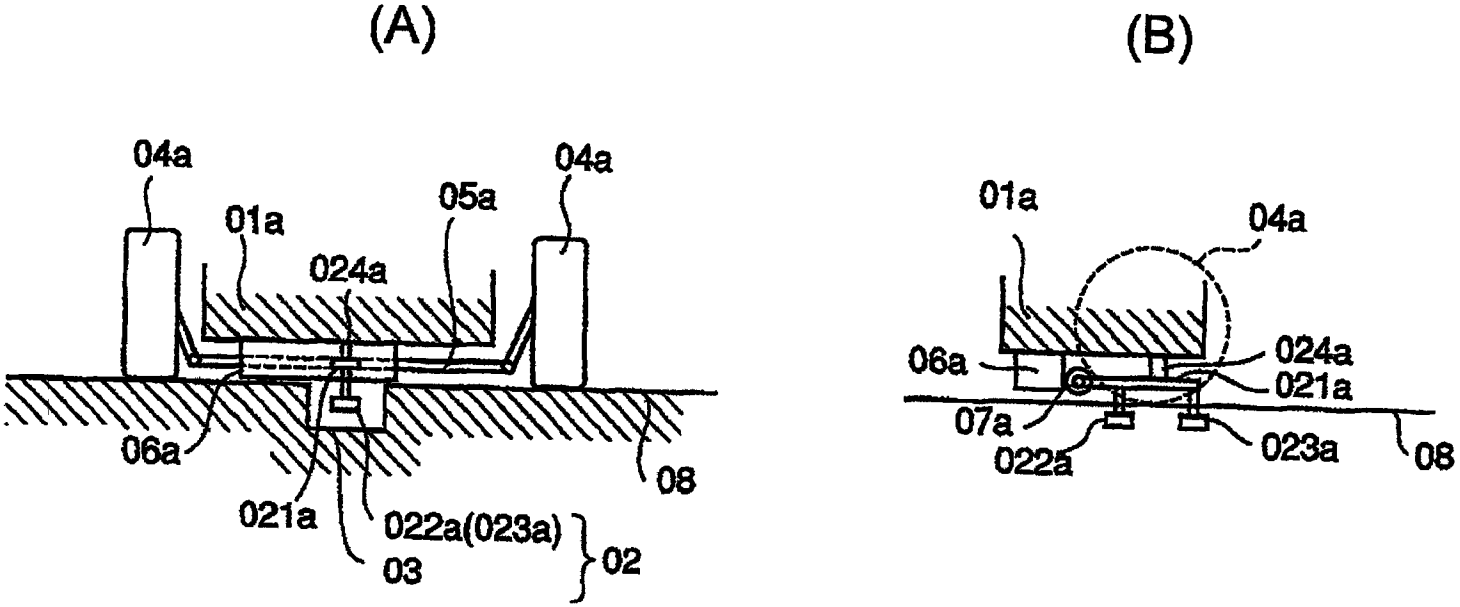
FIG. 13A is a schematic front elevational view of the prior art guided vehicle transportation system.
FIG. 13B is a side elevational view of FIG. 13A.
Figure 14:
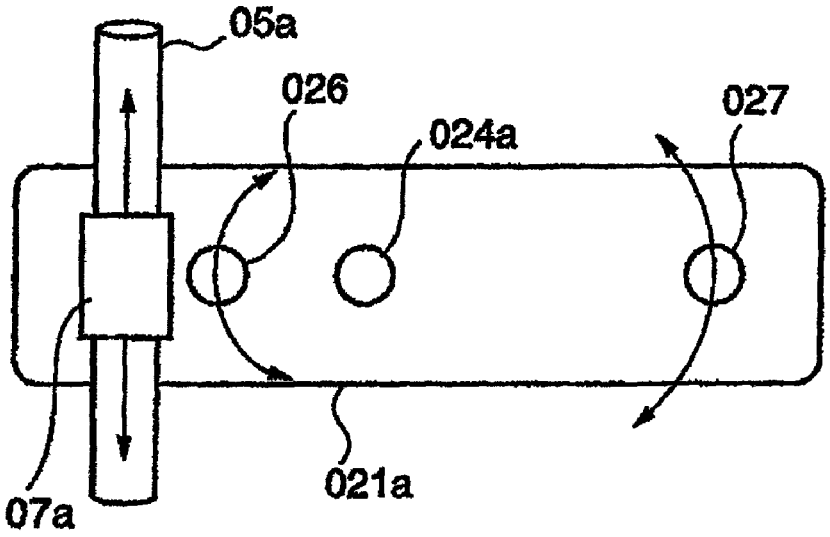
FIG. 14 is an enlarged plan view of the arm 021*a* and associated parts of the prior art guided vehicle transportation system.
Figure 15:
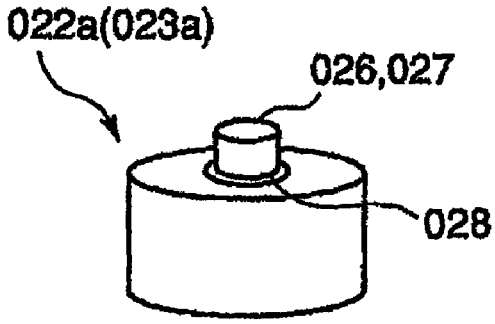
(PRIOR ART) FIG.15
FIG. 15 is a perspective view of the guard wheel 022*a* or 023*a* of the prior art guided vehicle transportation system.
Figure 16:
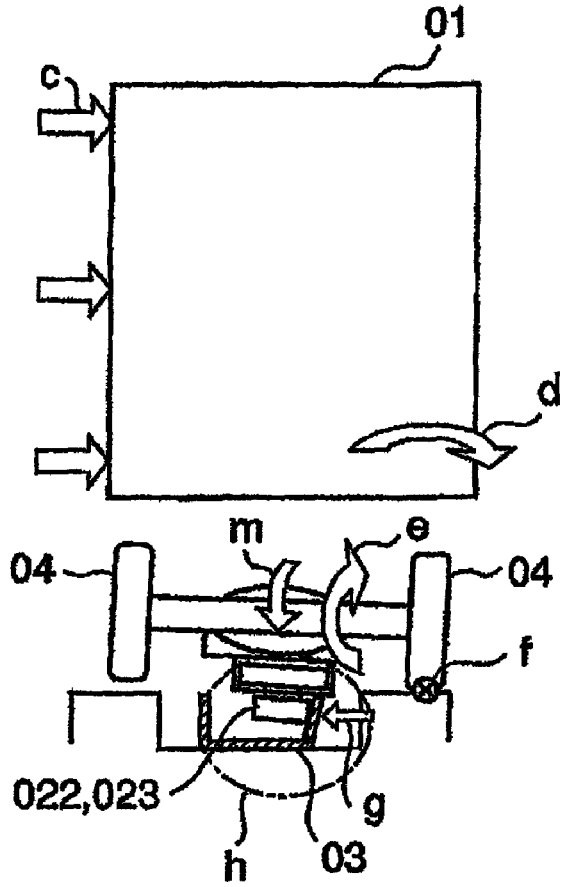
FIG. 16A is a schematic elevational view of the vehicle and fail-safe mechanism in the prior art guided vehicle transportation system for explaining action of external forces to the vehicle.
FIG. 16B is an enlarged view of the part surrounded by a circle h in FIG. 16A.
Figure 16:
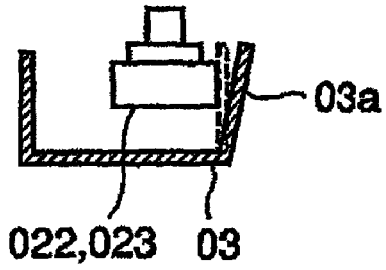

As shown in FIGS. 9 and 10, a claw 53 is provided to the under surface of the arm 22 to hook an end of a preloading spring 55, and a claw 54 is provided to the upper surface of the second arm 51 to hook the other end of the preloading spring 55. The preloading spring 55 works to press one of the guard wheels 22, 23 attached to both end parts of the second arm 51 to the guide surface 32 of one side of the guard rail 31, and press the other of the guard wheels 22, 23 to the guide surface 32 of the other side of the guard rail 31.

The preloading spring 55 presses the guard wheels 22, 23 against the guide surfaces 32 with a spring force not so strong, for example with a force of 10 kg or lower, in order not to affect the automatic steering mechanism and not to increase wear and reduce durability of the guard wheels 22, 23.

Crossing angle p between the longitudinal direction of the second arm 51 and travel direction of the vehicle 1 when the guard wheels 22 and 23 are contacting both the guide surfaces 32 of the guard rail 31 respectively while the vehicle is traveling, is 30° or smaller so that even if stepped parts exist at joining parts of the guard rail 31 the guard wheels proceed along the groove of the guard rail 31 while absorbing the impact to the guard wheels when the guard wheels pass the stepped parts on the guide surfaces 32 through rotation of the second arm 51 against energizing force of the preloading spring 55.

Construction other than that mentioned above is the same as that of the first embodiment, and parts and devices the same as the first embodiment are denoted by the same reference numerals and explanation is omitted.

As shown in FIG. 7C, according to the third invention, when lateral external force c exerts on the vehicle 1 when traveling, the vehicle 1 is pushed toward lee side until both of the guard wheels 22 and 23 contact the lee side guide surface 32 of the guard rail 31. As the spring force of the preloading spring 55 is determined to be not so strong, the second arm 51 is rotated easily until the guard wheels contacting the guide surface of windward side come to contact the guide surface of leeward side.

When lateral external force c is very strong, the rubber-tired wheel 4 of windward side tends to be raised, for the vehicle 1 tends to be heeled over about the ground contact point f of the rubber-tired wheel 4 of lee side, as already explained referring to FIG. 3 and FIG. 6 of the first and second embodiments respectively. But in this state the subsidiary guard wheels 33 on the guard wheels 22 and 23 are under the flange 34 of the guard rail 31, so tilting and toppling of the vehicle can be prevented.

Tilting or toppling of the vehicle 1 is prevented by reaction force from the flange to two guard wheels 22 and 23 in the third embodiment, load to one guard wheel is halved as compared with the first embodiments.

When exertion of the lateral external force c ceases, the normal traveling attitude of the vehicle 1 is recovered by the automatic steering mechanism and the vehicle travels with the guard wheels 22 and 23 contacting both the guide surfaces 32 of the guard rail 31 respectively pushed by the preloading springs 55 via the second arms 51 respectively.

In this embodiment, the guard wheels 22 and 23 are always contacting the guide surfaces 32 of the guard rail 31 pushed by the preloading spring 55 and the subsidiary guard wheels 33 are always right under the lower surfaces of the flanges 34 respectively, the upper surfaces of the subsidiary guard wheels 33, 33 come right under the lower surface of the flange 34 of lee side without fail to be engaged with the lower surface of the lee side flange when the vehicle 1 is moved toward lee side. Therefore, reliability of vehicle toppling prevention function can be increased. The guard wheels are increased in number by two times as compared with the first embodiment (4 guard wheels per 1 vehicle in the first embodiment and 8 guard wheels per 1 vehicle in the second and third embodiments), load exerted on each of the guard wheels when preventing tilting and toppling of the vehicle is halved as compared with the first embodiment as is in the second embodiment, so safety is increased in the case of the second and third embodiments.

As the second arm 51 is preloaded by the spring 55 so that the arm 51 is rotatable about the support shaft 24 supporting the arm 51 at the center thereof, impact that will exerts on the guard wheels when the guard wheels pass the steps at jointed parts of the guard rail or bifurcation area of the guard rail will be alleviated, so occurrence of damage to the guard wheels or other parts of the fail-safe mechanism can be eliminated or reduced. With the increase impact damping performance, ride quality is improved and occurrence of wear and damage of the guard wheels is prevented.

INDUSTRIAL APPLICABILITY

According to the invention, vehicle toppling prevention function can be improved by the fail-safe mechanism of simple construction in a guided vehicle transportation system in which the vehicle travels along a pre-established guideway while being steered automatically without using mechanical steering by use of guard wheels and a guard rail, etc. and provided with a fail-safe mechanism for securing safe steering when malfunction occurs in the automatic steering mechanism, and safety is increased and traveling of the vehicle at higher speed can be made possible.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. A guided vehicle transportation system in which a vehicle travels on a pre-established guideway having a depression as a guide track, the system comprising:

automatic steering mechanisms arranged for steering front wheels and rear wheels of the vehicle respectively by actuators;

guard wheels rotatably mounted to an under side of the vehicle in a lateral plane;

a guard rail positioned along a center line of the guide track, the guard rail having a groove in which the guard wheels are received with a predetermined clearance between the periphery of the guard wheels and side walls of the groove of the guard rail; and a fail-safe mechanism comprising the guard wheels and the guard rail, wherein said guard rail has a flange extending toward the groove of the guard rail at the top of each side wall, said vehicle has first arms extending in longitudinal direction of the vehicle and being attached to be rotatable about a support shaft located at a central part of an axle provided for suspending each pair of front wheels and rear wheels, each of said first arms are provided with second arms attached rotatably via second support shafts to both end parts of the first arms, and the guard wheels are attached rotatably to both end parts of the second arms, at least one of said guard wheels has thereon a subsidiary guard wheel smaller in diameter than that of the at least one guard wheel to be rotatable together with the at least one guard wheel, and said subsidiary guard wheel is disposed lower than said flange when the vehicle is moved laterally by lateral external force exerting on the vehicle, thereby heeling over of the vehicle is preventable by engagement of the subsidiary guard wheel with a lower surface of the flange.

2. The guided vehicle transportation system according to claim 1, wherein said guard rail has a I-shaped cross section having a flange extending laterally toward both sides at its top, or T-shaped cross section, the guard rail being laid down along the center line of the guide track, and guard wheels are received in grooves formed with both side walls of the guard rail and both side walls of the guide track which is a depression formed along the guideway with the predetermined clearance between the periphery of the guard wheels and the side walls of the I-shaped guard rail and that of the guide track.

3. The guided vehicle transportation system according to claim 1, wherein said guard rail having a groove is shaped such that a flange part extends toward the groove horizontally from each of upper parts of both side walls respectively.

* * * * *